US006453881B1

(12) United States Patent
Gras

(10) Patent No.: US 6,453,881 B1
(45) Date of Patent: Sep. 24, 2002

(54) METHOD OF AND SYSTEM FOR CONTROLLING FUEL SUPPLY AGGREGATES IN MOTOR VEHICLES AND A VEHICLE PROVIDED THEREWITH

(75) Inventor: Juergen Gras, Bietigheim-Bissingen (DE)

(73) Assignee: Robert Bosch GmbH, Stuttgart (DE)

( * ) Notice: Subject to any disclaimer, the term of this patent is extended or adjusted under 35 U.S.C. 154(b) by 27 days.

(21) Appl. No.: 09/610,399

(22) Filed: Jul. 5, 2000

(30) Foreign Application Priority Data

Jul. 5, 1999 (DE) ..... 199 30 860

(51) Int. Cl.[7] ..... F02M 37/04; F04B 41/06

(52) U.S. Cl. ..... 123/509; 417/426; 123/198 D; 123/516; 137/565.33

(58) Field of Search ..... 123/516, 198 D, 123/510, 509; 137/39, 44, 565.33, 565.37; 417/62, 107, 125, 2, 3, 426, 286; 220/562, 563, 564

(56) References Cited

U.S. PATENT DOCUMENTS 2,459,807 A * 1/1949 Gavin et al. ..... 137/565.33
2,835,323 A * 5/1958 Booth ..... 137/565.33
3,010,509 A * 11/1961 Scherenberg ..... 137/565.33
3,442,218 A * 5/1969 Wess ..... 137/565.33
3,915,184 A * 10/1975 Galles ..... 137/43
4,546,750 A * 10/1985 Brunell et al. ..... 123/514
4,591,115 A * 5/1986 DeCarlo ..... 244/135 C
4,683,864 A * 8/1987 Bucci ..... 123/575
4,860,714 A * 8/1989 Bucci ..... 123/514
5,197,444 A * 3/1993 Lang et al. ..... 123/514
5,855,197 A * 1/1999 Kato ..... 123/516

FOREIGN PATENT DOCUMENTS

DE 195 04 217 A1 8/1996

* cited by examiner

*Primary Examiner*—Carl S. Miller
(74) *Attorney, Agent, or Firm*—Michael J. Striker

(57) ABSTRACT

In a fuel supply system for an internal combustion engine of a motor vehicle with at least two fuel feeding aggregates arranged in a fuel tank, a control unit controls the fuel feeding aggregates, so that in dependence on determined data for longitudinal and/transverse inclination angles of the vehicle, at least one of the fuel feeding aggregates which provides a suction of fuel.

18 Claims, 3 Drawing Sheets

Fig.1
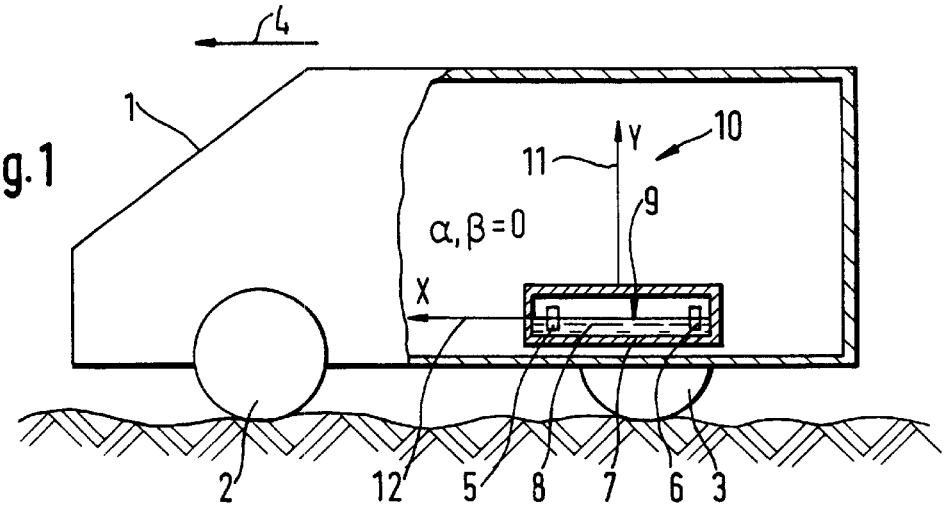
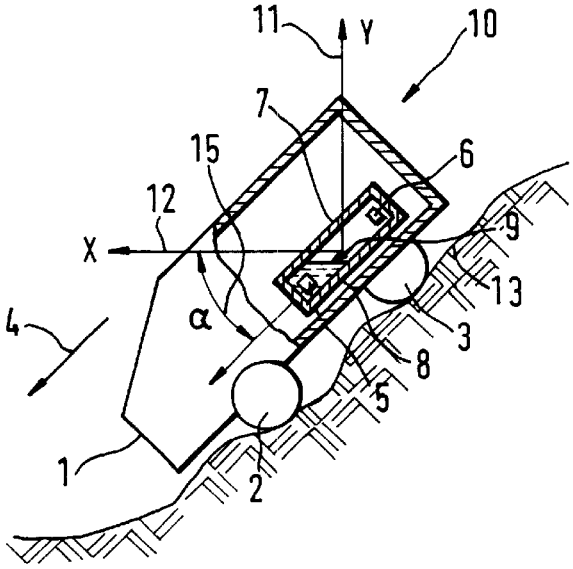
Fig. 2
Fig.3
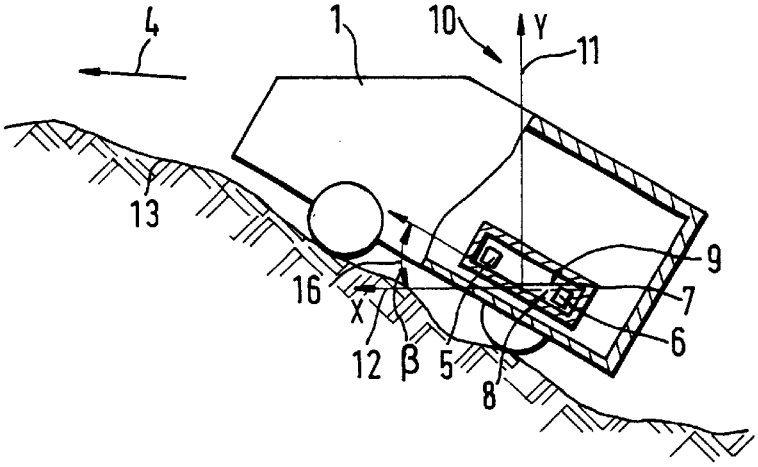

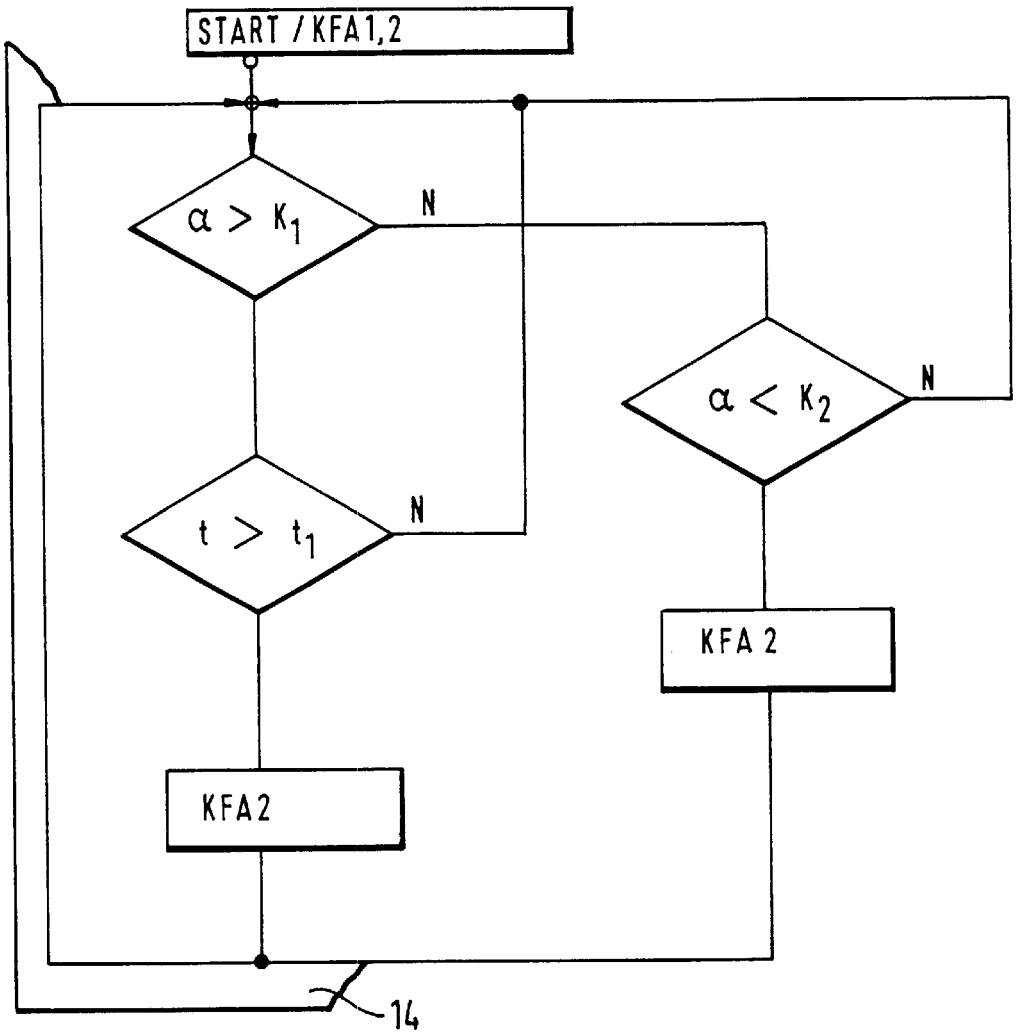
Fig. 4
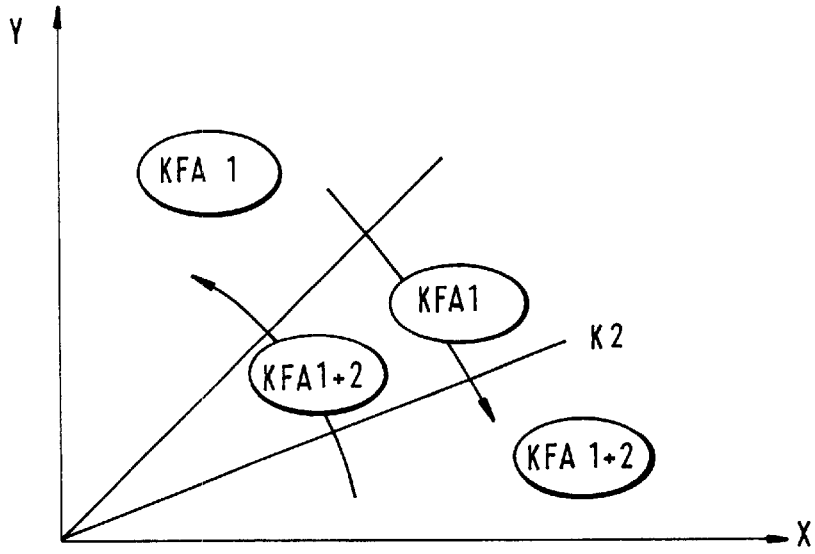

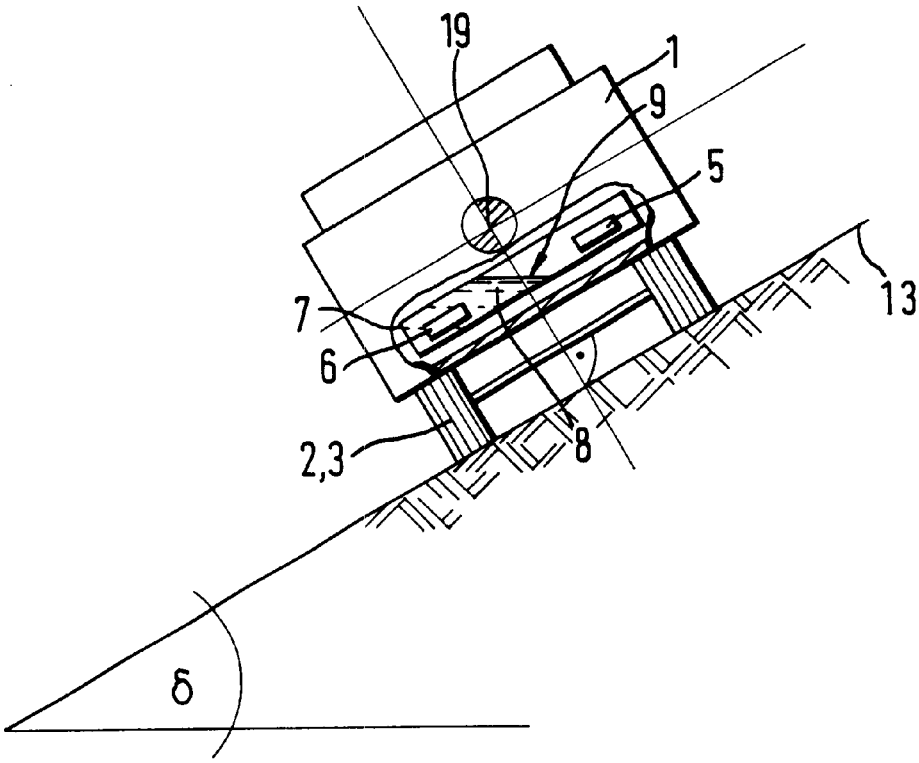
Fig. 5
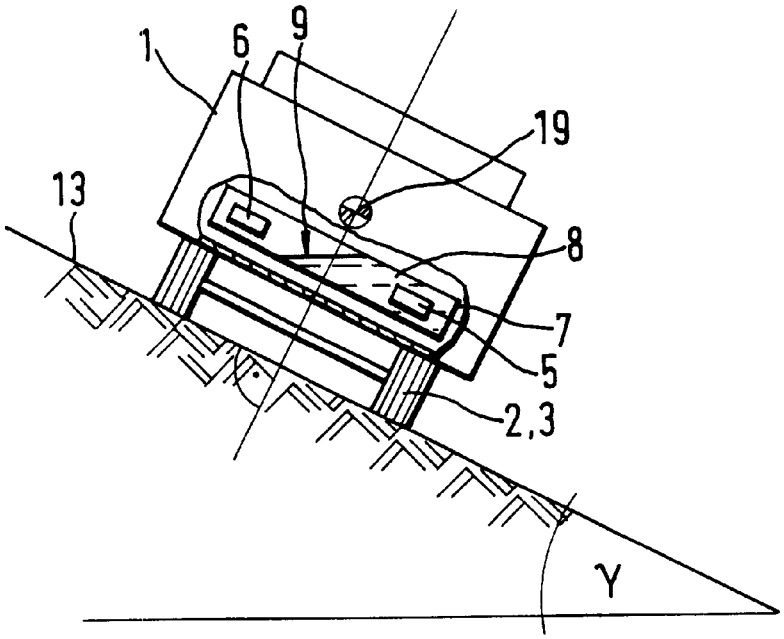

METHOD OF AND SYSTEM FOR CONTROLLING FUEL SUPPLY AGGREGATES IN MOTOR VEHICLES AND A VEHICLE PROVIDED THEREWITH

BACKGROUND OF THE INVENTION

The present invention relates to a method of and a system for controlling fuel feeding aggregates in motor vehicles, as well as to a vehicle provided therewith and having two or more electrical fuel feeding aggregates.

German patent document DE 195 04 217 A1 discloses a device for feeding fuel from the supply tank to an internal combustion engine of a motor vehicle. The device has a container arranged in a supply tank, from which a feeding aggregate aspirates the fuel and feeds it to the internal combustion engine. A fuel conduit branches from the pressure side of the feeding aggregate. It opens into a supply tank and is connected to a suction jet pump. The suction jet pump feeds fuel from the supply tank into the container. A throttle is arranged in the fuel conduit upstream of the suction jet pump. As a result, the fuel which exits from the suction jet pump has a lower pressure than at the pressure side of the feeding aggregate. Thereby the fuel which flows from the suction jet pump in heated condition has less tendency for evaporation and the operation of the suction jet pump is improved.

When in the modern constructions two or more electrical fuel pumps are arranged in a supply tank, they are can be controlled simultaneously or in other words controlled electrically parallel to one another. Thereby it is guaranteed that in each inclined position of the motor vehicle, the fuel supply is provided. This however has a disadvantage that as a result a high electrical power consumption of the electric fuel pumps takes place, and the high fuel return flow in the tank causes heating of the tank. With the parallel control of all fuel pumps, disturbing flow noise and pump noise can be generated.

Individual electrical fuel pumps which are incorporated in an electrical, parallel-operating control can not be easily diagnosed. A dry running of a single electrical fuel pump can not be reliably prevented, since with the parallel electrical control, all fuel feeding aggregates are controlled simultaneously.

SUMMARY OF THE INVENTION

Accordingly, it is an object of present invention to provide a method of and a system for controlling fuel feeding aggregates in motor vehicles as well as a motor vehicle provided therewith which avoids the disadvantages of the prior art.

In accordance with the inventive method, in dependence on the data determined by a control unit about longitudinal and/or transverse angles of the motor vehicle, such fuel feeding aggregates are controlled which guarantee an efficient aspiration of fuel.

In all-wheel vehicles, for example military vehicles, the available inclination angle information can be evaluated through a longitudinal and a transverse inclination angles of the vehicles. In dependence on the determined inclination angle of the motor vehicle on the ground with consideration of the mounting position of the electrical fuel pump, only that fuel pump is controlled which guarantees an efficient aspiration of fuel even with a low tank filling level. The control of the fuel feeding aggregates in dependence on the inclination angle information of the motor vehicle reduces the electrical power consumption significantly, since only that feeding aggregate is controlled which guarantees a reliable fuel supply. A fuel return and heating of the tank connected therewith in the inventive control method is substantially lower. Furthermore, the generated flow noise and the pump noise which can occur during operation of the fuel feeding aggregate is reduced to an unchanged minimum.

It is also another feature of present invention to provide a vehicle with the above mentioned control system and method.

In the inventive fuel supply system the control unit is formed so that, depending on the data of the longitudinal and/or transverse inclination of the vehicle, it controls such fuel feeding aggregates that guarantee an efficient aspiration of fuel.

In accordance with a preferable embodiment of the present invention, the switching of the fuel feeding to a fuel feeding aggregate is performed after elapsing of a preselected time period. Thereby during a transition time period the fuel supply is guaranteed. It involves an additional electrical power consumption, however only for a limited time. Preferably the switching of one or several fuel feeding aggregates is performed when a threshold value for the longitudinal or side inclination of the vehicle chassis is detected for a longer time period. In the event of short inclination change, a switching between various fuel feeding aggregates can be avoided. Depending on the terrain configuration at which the vehicle has to deal, the threshold for the vehicle inclination in longitudinal or transverse direction, whose exceeding causes the desired control of a fuel feeding aggregate, can be provided individually and adjusted independently from one another.

In accordance with a preferable embodiment of the inventive method, a switching over condition for a first fuel feeding aggregate can be determined so that for positive angle $\beta$ which is greater than a threshold $k_1$ a switching off of the first feeding aggregate is performed. This condition must be fulfilled for a first time period $t_1$, until the switching off of the first fuel feeding aggregate is performed. On the other hand, a switching of the first fuel feeding aggregate to a fuel feeding aggregate maintaining the fuel supply can be performed when the corresponding detected positive angle $\beta$ is less than the threshold value $k_2$. The threshold value $k_2$ is selected smaller than $k_1$ whereby a hysteresis condition can be produced, to exclude switching on and off between the fuel feeding aggregates during passage of a terrain portion under the angle $\beta$ When with the angle variables $\beta$ the inclinations of a motor vehicle around a transverse action in clockwise direction are identifiable, then the method is expanded in advantageous manner by detection of the angle a occurring opposite to the clockwise direction around the transverse axis. Analogously, the detected negative angles $\alpha$ which are greater than a predeterminable threshold value $k_1$ can be used as a switching condition for the switching off of a further fuel feeding aggregate. This angle a also can occur for a time period $t_2$, until the switching off of the further feeding aggregate is performed. When the continuously occurring angle $\alpha$ is located under the threshold $k_2$ then a new switching of a fuel feeding aggregate for taking over the fuel supply is performed. For the threshold value it is true that the threshold value $k_2$ is less than the threshold value $k_1$.

With modern vehicle electronic systems, vehicle computers, navigation devices or the like, the data for vehicle inclination about transverse and/or longitudinal axis, can be determined in cycles and continuously supplied to the control unit.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a simplified side view of a motor vehicle with two fuel feeding aggregates arranged in a fuel tank on a flat surface;

FIG. 2 is a view showing the vehicle of FIG. 1 during passage of a lowering terrain portion;

FIG. 3 is a view showing the vehicle of FIG. 1 during passage over a raising terrain portion;

FIG. 4 is a view showing a flow diagram which represents an operation of a control unit for at least two fuel feeding aggregates;

FIG. 5 is a view showing a motor vehicle of FIG. 1 during an inclined drive on a terrain raised portion.

DESCRIPTION OF THE PREFERRED EMBODIMENTS

FIG. 1 shows a side view of a motor vehicle which is illustrated in a simplified way. It has two fuel feeding aggregates arranged in a fuel tank and is located on a flat surface.

A tank 7 is arranged in a motor vehicle 1 above the rear axle 3. The tank can be located also in the lower part of the motor vehicle 1 between the front axle 2 and the rear axle 3. In the shown embodiment the tank 7 which has a rectangular cross-section is provided with two fuel feeding aggregates 5 and 6. They can be arranged in the center of the tank 7. In addition to the fuel pumps which operate here as the feeding aggregates 5 and 6 shown in the side view, at the opposite side of the tank 7 further fuel feeding aggregates can be located opposite to the first mentioned fuel feeding aggregates. Therefore for example with the rectangular base surface of the tank, the fuel feeding aggregates 5 and 6 are arranged in the four corners of the tank 7.

The fuel 8 in the tank 7 has in the shown example a relatively low level height 9. A coordinate system 10 is arranged with its initial point inside the tank 7. The Y axis 11 extends perpendicular to the traveling direction 4, while the X axis 12 extends in the traveling direction 4. On a flat surface which is shown in FIG. 1, the angles $\alpha$ and $\beta$ amount to substantially zero. Therefore in this traveling situation of the vehicle 1 instead of the fuel feeding aggregate 1 identified with reference numeral 5 and the further fuel feeding aggregate identified with reference numerals 6, one fuel feeding aggregate can be operated as a main feeding aggregate. The one or several fuel feeding aggregates can be turned off.

FIG. 2 shows the vehicle 1 which is illustrated in FIG. 1, during passage of a lowering terrain portion. The vehicle 1 which passes the back terrain portion 13 as considered in the traveling direction 4 is inclined forwardly relative to the horizontally extending X axis 12 of the coordinate system 10, by a negative angle $\alpha$. Thereby also the tank 7 together with the fuel supply 8 located in it are inclined forwardly, so that the first fuel feeding aggregate 5 is completely surrounded by the fuel 8. To the contrary, the second fuel feeding aggregate 6 runs dry, and due to its mounting position during inclination of the vehicle 1 by the angle $\alpha$ forwardly, no fuel can be fed. In order to avoid a dry running of the further fuel feeding aggregate 6 and an unnecessary power consumption of this fuel pump, it is turned off when the vehicle 1 is in the inclined position shown in FIG. 1.

The condition for the turning off of the further fuel feeding aggregate 6 is first of all that the inclination angle $\alpha$ exceeds a predetermined threshold value k. Moreover, the turning off of the further fuel feeding aggregate 6 is performed after elapsing of a time period $t_1$. The inclination situation of the vehicle 1 must continue for a time, until the switching off of the further fuel feeding aggregate 6 is performed by the control unit 14. During the time period $t_1$ several fuel feeding aggregates can be in operation, while after elapsing of the time period $t_1$ in the shown example, the fuel supply is guaranteed only through the first fuel feeding aggregate, until the longitudinal and/or transverse inclination position of the motor vehicle 1 on the ground again changes, and with the vehicle electronic system another inclination parameter is detected and transmitted to the control unit 14.

FIG. 3 shows a vehicle which passes a raising portion on the ground. With respect to the horizontally oriented coordinate system composed of Y axis 11 and X axis 12, the tank 7 is inclined in correspondence with the inclination of the motor vehicle 1 by the angle $\beta$. The fuel supply 8 in the tank 7 together with the rear region of the tank 7 is inclined so that the first fuel feeding aggregate 5 starts running dry. In contrast, the further fuel feeding aggregate 6 is completely surrounded by the fuel 8 and can maintain the feeding of the fuel 8 in the inclined position to the internal combustion engine. When the positive angle $\beta$ shown here at the beginning of the coordinate system 10 exceeds the predetermined threshold value 1 and the inclination at the angle $\beta$ continues for a time period $t_2$, then the switching off of the first fuel feeding aggregate 5 is performed. The fuel supply is then maintained by the further fuel feeding aggregate 6. The time periods $t_1$ and $t_2$, after which a turning off of the fuel feeding aggregates can be performed due to their mounting position in corresponding traveling situations on the terrain to provide no fuel supply, are freely preselectable and changeable independently from one another.

In addition to the inclination angles around the transverse axis as shown in FIGS. 2 and 3, in accordance with the inventive method also inclination angles around the longitudinal axis of the vehicle 1 can be detected. When the tank 7 uses for example more than two fuel feeding aggregates, then during tilting of the vehicle 1 around the longitudinal axis, it can be guaranteed that the fuel 8 is supplied by the fuel feeding aggregate which is surrounded by fuel, while contrary to this, the fuel feeding aggregate which can not supply the fuel due to the tilting of the vehicle, can be turned off. Instead of the inclination angles $\alpha$ and $\beta$, here with a coordinate system inclination angles $\partial$ and $\nu$ are measured and the pumps on the corresponding side of the tank 7 are correspondingly controlled or stopped.

FIG. 4 shows a flow diagram in a very simplified way, for the operation of the control unit 14 of the fuel feeding aggregates.

The data of inclination of the motor vehicle 1 are transmitted to the control unit 14. They can be determined by the vehicle electronic system continuously or in cycled intervals. When it is determined that the angle $\alpha$ and $\beta$ swings from the value zero, then during the operation of the vehicle 1 on a flat surface a fuel feeding aggregate 5 or 6 remain in operation as main pumps. The remaining feeding aggregates can be turned off. In these cases, the individual fuel feeding aggregates are controlled after one another, to determine eventually occurring defects. For a system check, the fuel pressure signal, the running quietness or the lambda regulation can be used.

FIG. 4 shows the fuel feeding aggregate 1 identified with reference numeral 5 and the further fuel feeding aggregate 2 identified with reference numeral 6 at the beginning of the operation. In the first inquiry routine it is determined whether an occurring inclination angle $\alpha$ exceeds a predeterminable threshold value $k_1$ or not. If this is not the case, in a further inquiry routine, it is determined whether $\alpha$ is smaller than the threshold value $k_2$. If the answer is affirmative, the further fuel feeding aggregate 2 identified with reference numeral 6 remains turned on and supplies further fuel. In the case of negative response to the inquiry, a return to start is performed.

If the first mentioned inquiry routine leads to a positive result, an inquiry is performed whether the condition a greater than $k_1$ is maintained for a predetermined time period t greater than $t_1$. If the answer is "no", a return to the start is performed. Both feeding aggregates remain further in operation. When the time period t exceeds a predetermined time period $t_1$, the further fuel feeding aggregate 2 identified with reference numeral 6 is turned off.

As shown by way of example for an occurring inclination angle $\alpha$ is true also for occurring angles $\beta$, $\nu$ and $\partial$, they correspond to the inclination of the vehicle around the longitudinal or transverse axis.

In the X-Y coordinate system shown in FIG. 4, the both fuel feeding aggregates are in operation and also in a transition region for the inclination angles $\alpha$, $\beta$, $\nu$ or $\partial$ between the threshold values $k_1$ and $k_2$. When the corresponding inclination angle $\alpha$ continuously exceeds the greater threshold value namely $k_1$, the further feeding aggregate is turned off and the feeding is guaranteed only by the first fuel feeding aggregate 1 identified with reference numeral 5. When the angle $\alpha$, $\beta$, $\nu$ or $\partial$ exceeds the threshold value $k_1$, but remains above the threshold value $k_2$, which is smaller than $k_1$, the fuel supply is maintained by the first fuel feeding aggregate 1 identified with reference numeral 5. When the threshold value $k_2$ is exceeded, the switching on of the further fuel feeding aggregate 2 identified with reference numeral 6 is performed.

FIG. 5 shows a vehicle of FIG. 1 during the inclined drive over a terrain raising portion. The drawing clearly shows the tilting of the vehicle 1 about its longitudinal axis 9, whereby the fuel level 9 in the tank 7 displaces correspondingly to the tilting angle $\nu$ or $\partial$. Thereby in the case of inclination by an angle $\partial$, the fuel feeding aggregate 5 is cut off from the fuel level in the tank 7, while the fuel feeding aggregate 6 is completely surrounded by the fuel 8 in the tank. With the control unit 14 in the case of tilting of the vehicle 1 by an angle $\partial$ about its longitudinal axis 19, the fuel feeding aggregate 5 is turned off, while the fuel feeding aggregate 6 guarantees the fuel supply.

Analogously when the vehicle 1 tilts around its longitudinal angle 19 by an angle $\nu$, the fuel feeding aggregate 5 is completely surrounded by the fuel 8, while the fuel feeding aggregate 6 is cut off from the fuel 8. In this case the fuel feeding aggregate 5 provides the fuel supply during tilting around the angle $\nu$.

It will be understood that each of the elements described above, or two or more together, may also find a useful application in other types of methods and constructions differing from the types described above.

While the invention has been illustrated and described as embodied in method of and system for controlling fuel supply aggregates in motor vehicles and a vehicle provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A method of feeding fuel from a supply tank to an internal combustion engine, comprising the steps of arranging a plurality of fuel feeding aggregates in the supply tank; separately controlling the fuel feeding aggregates by a control unit, and, in dependence on data determined by the control unit and related to longitudinal and/or inclination angles of the vehicle, controlling at least one of said fuel feeding aggregates, wherein said at least one of said fuel feeding aggregates is controlled and operated, when sufficiently surrounded by fuel, to feed fuel to the internal combustion engine and wherein the remaining fuel feeding aggregates are deactivated upon operation of said at least one of said fuel feeding aggregates.

2. A method as defined in claim 1; and further comprising switching of fuel feeding from said one fuel feeding aggregate to a further fuel feeding aggregate after elapsing of a pre-selected time period.

3. A method as defined in claim 1; and further comprising switching of fuel feeding from said one fuel feeding aggregate to a further fuel feeding aggregate after performing a pre-selected number of ignitions and/or injections.

4. A method as defined in claim 1; and further comprising switching of fuel supply from said one fuel feeding aggregate to a further fuel feeding aggregate after a predetermined, pre-selectable covered travel.

5. A method as defined in claim 1; and further comprising switching of fuel supply from said one fuel feeding aggregate to a further fuel feeding aggregate after use of a predeterminable air and/or fuel mass.

6. A method as defined in claim 1; and further comprising switching of fuel supply from said one fuel feeding aggregate to a further fuel feeding aggregate after exceeding a threshold value of the inclination angle.

7. A method as defined in claim 6; and further comprising individually pre-selecting the threshold value.

8. A method as defined in claim 6, wherein the threshold value includes two separate threshold values which are pre-selectable independently from one another.

9. A method as defined in claim 1; and further comprising switching of fuel supply from said one fuel feeding aggregate to said further feeding aggregate and vice versa; and during the switching, operating both said fuel feeding aggregates in parallel for a predetermined time period.

10. A method as defined in claim 9; and further comprising switching off of said one fuel feeding aggregate when a switching condition correspond to a positive angle $\beta$ greater than the threshold value.

11. A method as defined in claim 10; and further comprising switching off of said one fuel feeding aggregate after a time period $t_1$.

12. A method as defined in claim 10; and further comprising switching on of said one fuel feeding aggregate when a positive angle $\beta$ is smaller than a threshold value hysteresis.

13. A method as defined in claim 9; and further comprising performing switching off of the further fuel feeding aggregate when a negative angle $\alpha$ is greater than the threshold value.

14. A method as defined in claim 13; and further comprising switching off of said further feeding aggregate after a time period $t_2$.

15. A method as defined in claim 9; and further comprising performing switching on of the further fuel feeding aggregate at a negative angle $\alpha$ smaller than a threshold value hysteresis.

16. A method as defined in claim 1; and further comprising determining the data for longitudinal and/or transverse inclination of the motor vehicle cyclically by the control unit.

17. A fuel supply system, comprising a fuel tank provided with a plurality of fuel feeding aggregates; a control unit for controlling said fuel feeding aggregates, said control unit being operative so that, in dependence on data about longitudinal and/or transverse inclination of a motor vehicle, at least one of said fuel feeding aggregates is controlled, wherein said at least one of said fuel feeding aggregates is controlled and operated, when sufficiently surrounded by fuel, to feed fuel to the internal combustion engine and wherein the remaining fuel feeding aggregates are deactivated upon operation of said at least one of said fuel feeding aggregates.

18. A land vehicle, comprising a fuel supply tank provided with a plurality of feeding aggregates; a control unit for controlling said fuel feeding aggregates, said control unit being operative so that, in dependence on data about longitudinal and/or transverse inclination of a motor vehicle, at least one of said fuel feeding aggregates is controlled, wherein said at least one of said fuel feeding aggregates is controlled and operated, when sufficiently surrounded by fuel, to feed fuel to the internal combustion engine and wherein the remaining fuel feeding aggregates are deactivated upon operation of said at least one of said fuel feeding aggregates.

* * * * *